United States Patent [19]

Grossi

[11] 4,309,868

[45] Jan. 12, 1982

[54] ROTATING RING FOR SPINNING AND TWISTING MACHINES

[75] Inventor: Oscar Grossi, Bologna, Italy

[73] Assignee: Officine Savio S.p.A., Pordenone, Italy

[21] Appl. No.: 953,522

[22] Filed: Oct. 23, 1978

[51] Int. Cl.[3] ..... D01H 7/56

[52] U.S. Cl. ..... 57/124; 57/125

[58] Field of Search ..... 57/119, 121, 122, 124, 57/125

[56] References Cited

U.S. PATENT DOCUMENTS

| | | | |
|---|---|---|---|
| 660,628 | 10/1900 | Draper | 57/124 |
| 714,966 | 12/1902 | Sullivan | 57/124 |
| 2,725,712 | 12/1955 | Rooney | 57/124 |
| 3,114,234 | 12/1963 | Kobayashi et al. | 57/124 |
| 3,494,120 | 2/1970 | Chilpan et al. | 57/124 |
| 3,981,135 | 9/1976 | Huber et al. | 57/124 |
| 4,104,857 | 8/1978 | Grandi | 57/124 |
| 4,150,531 | 4/1979 | Marzoli | 57/124 |
| 4,161,863 | 7/1979 | Marzoli | 57/122 X |

*Primary Examiner*—John Petrakes

*Attorney, Agent, or Firm*—Townsend and Townsend

[57] ABSTRACT

A device for the passage and the guiding of the yarn travelling towards the spool for textile and twisting machines comprising a plurality of spindles, each mounted within a ring supported by a ring rail. The device comprises a rotating ring (6) so mounted on and supported by a respective coaxial ring (2) carried by the ring rail (1) as to be able to freely rotate. An eyelet (7) is inserted through the rotating ring, extending upwardly beyond it and provided with an outer entrance passage for the insertion of the yarn (5). The end (*7a*) of said eyelet (7), which is positioned over said passage, is bent innerwardly so as to form a hook, while the other end (*7b*), which is positioned below said passage, projects outwardly so as to form an arm of a length sufficient to be able to rest on the upper surface of the ring (2) fixed to the ring rail (1). The eyelet extends through a horizontal slot (8) arranged in the wall of the rotating ring (6) and so shaped and dimensioned as to allow the eyelet (7) to orient itself in different vertical planes in response of a traction effect produced by the bobbin (4) on the yarn (5).

7 Claims, 4 Drawing Figures

ROTATING RING FOR SPINNING AND TWISTING MACHINES

The present invention relates to a device for the passage and the guiding of a yarn travelling towards the spool for textile spinning and twisting machines including a plurality of rotating spindles co-operating with a ring rail supporting a plurality of rings. The device comprises a rotating ring mounted coaxially to and supported in the inside of each ring of the ring rail. The rotating ring can freely rotate about the associated spool supported by a rotating spindle and is provided with an eyelet having an entrance passage for the yarn as its outer side. An end portion of the eyelet is placed over the passage and is bent innerwardly so as to form a hook in order to hold the yarn therein. The lower end of the eyelet extends outwardly so as to be able to rest on the upper surface of the ring fixed to the ring rail. The lower end of the eyelet extends through a horizontal slot arranged in the rotating ring, which slot is so shaped as to permit the eyelet to orient itself in different, substantially vertical planes.

Conventional ring spinning and twisting systems provision included so that each spindle which carries a bobbin rotates within a ring carried by a ring rail which reciprocates up and down. The yarn being fed to the bobbin travels through a traveller slidably mounted on said ring and which rotates along said ring as a result of the spool rotation. The traveller rotates at a speed which can attain a maximum of about 38 m/sec. This speed constitutes a technical limit in the performances of the ring spinning and twisting operations of the known types.

For the purpose of increasing the limit, provisions have been made to substitute the conventional guiding traveller with a guiding device of a rotating ring, coaxial to the spindle and freely rotatable on the inside of the conventional ring fixed on the ring rail. A radial hole is arranged through the rotatable ring for the passage and the guiding of the yarn which has to be wound on the bobbin. The rotating ring can be rotated by the yarn because of the very small pressure which the rotating ring creates on the fixed ring and because of the interposition of sliding bearings or by pneumatic means between the two rings. This solution permits an increase of the peripheric speed from the previous 38 m/sec to about 60 m/sec.

This solution presents the inconvenience that as the yarn passes through the radial hole of the rotating ring it is subjected to a high friction effect because the hole has a fixed radial orientation, while the diameter of each yarn turn changes. This in turn causes the production of a yarn of low quality since it becomes hairy on account of the presence of broken and clotted fibres.

The present invention, on the other hand, enables one to obtain a yarn or a twisted thread of a quality equal to that which is at the present obtained by the use of the traveller systems, even when the rotating ring operates at the above-mentioned high speeds. This is accomplished by substituting for the hole acting as yarn guiding means an eyelet which is always maintained in a substantially vertical plane. The eyelet is inserted through the rotating ring and it is mounted so as to automatically orient itself in such a way as to maintain a constant exit angle of the yarn coming out of said eyelet provided for the passage and the guiding thereof.

These and other characteristics of the invention will be better understood from the following description of an embodiment of the invention, taking in consideration the accompanying drawing, in which.

Figure 1:
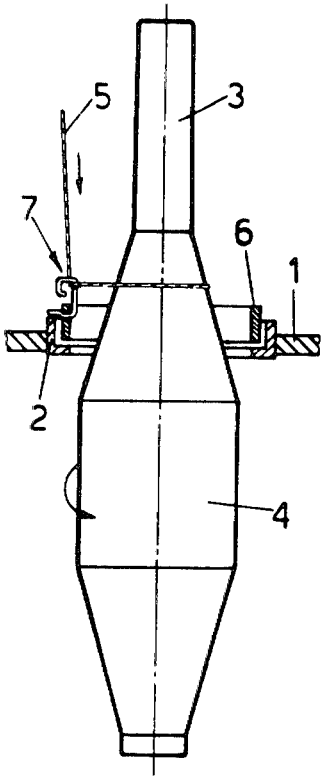
FIG. 1 shows an axial sectional view of the device of the invention mounted on a ring rail, while the associated spool in shown in a side view.

In the drawing the devices of the spinning and twisting machines have not shown since they are conventional and not pertinent to the device of this invention. In the drawing at 1 is indicated a ring rail on which is shown a ring 2 which is one of the plurality of rings carried by said ring rail 1. A yarn 5 is to be wound about a tube 3 so as to form a bobbin 4. A coaxial ring 6 is suspended within ring 2 by means of a sliding bearing or a pneumatic supporting device both of which are well known in the art and therefore not shown.

Rotating ring 6 carries an eyelet 7 which serves for the passage and the guiding of the yarn 5 and which extends upwardly beyond ring 6. The yarn 5 coming from a spinning or twisting unit, passes through eyelet 7 and is wound about tube 3 mounted on a spindle (not shown) which is conventionally rotated.

Figure 2:
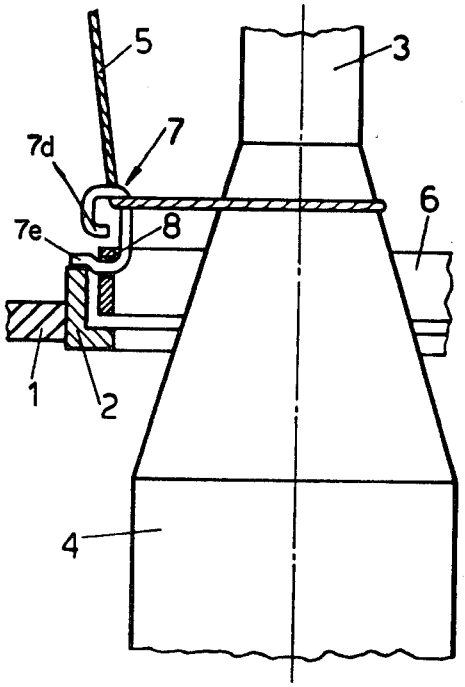
FIG. 2 is a detail of FIG. 1 in an enlarged scale.
Figure 3:
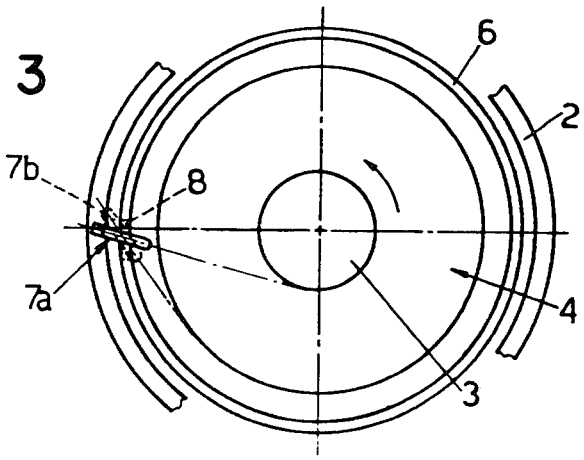
FIG. 3 is a top view of the assembly of FIG. 1.

The eyelet 7 is inserted through a horizontal slot 8 arranged in the wall of the ring 6 so that said eyelet 7 can always remain substantially perpendicular to the ring rail plane (FIG. 2) and so that it can freely take various orientations in substantially vertical planes. In this manner the eyelet can automatically position itself in a vertical plane which comprises the tangent to the yarn turn at the point where said yarn begins to be wound about bobbins 4. In particular in FIG. 3 in full lines is shown the eyelet 7 in the position *7a*, in which the yarn wound onto a turn of a minimum diameter, while in broken lines is shown the position *7b* of the eyelet 7 when the yarn is being wound onto a turn of maximum diameter so as to better see the angular displacements of the eyelet 7 of the device of the present invention. This angular displacements is essential in order to have the smallest and constant exit angle of the yarn 5 with respect of the plane of the eyelet 7 so as to prevent that the yarn 5 exits at greater angles which can produce a strong friction of the yarn against the edge of the guiding means as is common in the prior system providing a rotating ring having a radial guiding hole. Owing to the solution of the problem provided by the present invention a uniform, even and non-hairy thread or twisted yarn will be obtained.

The eyelet 7 is so shaped as to permit an easy insertion of the yarn 5 therethrough and at the same time so as to prevent that the yarn can come out during the stopping of the machine, i.e. when the traction applied to the yarn by the rotation of the spool 4 is interrupted.

Figure 4:
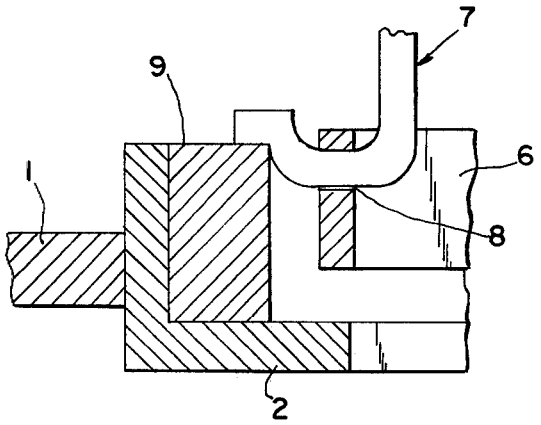
FIG. 4 is a sectional view of the assembly of FIG. 1, illustrating emplacement of a reduction ring.

For such a purpose eyelet 7 has a ring-like shape with an entrance passage on its outer side. The upper end *7d* of eyelet 7 (FIG. 2) is bent inwardly so as to give it the form of a hook capable of keeping back the yarn when the traction applied to it ceases. The lower end *7e* of eyelet 7, located generally outward of its lower curved portion, is extended horizontally towards the outside and forms an arm *7e* which is spaced apart from the end portion *7d* sufficiently to define the passage for the insertion of the yarn 5. Further, arm *7e* has such a length so as to enable it to rest on the upper surface of the ring 2. The pressure applied by the arm 7*e* on the ring 2 increases as the centrifugal force increases so that the greater the centrifugal force is, the greater is the friction effect between the arm 7*e* and the stationary ring 2. This serves to maintain the yarn 5 under a substantially constant tension because, as the speed increases, the friction also increases, but that depends also upon the weight of the eyelet 7. As a result thereof, if yarns of different deniers and resistance have to be worked, it is necessary to vary the weight of the eyelet 7. In addition, in the event that bobbins of different maximum diameters have to be obtained, rings 6 of different sizes have to be used so that when the maximum diameter of the bobbins will be reduced, it is necessary to use a rotating ring 6 of an accordingly smaller diameter which will be supported by rotating ring 6 with the interposition of another ring of a diameter accordingly smaller; i.e. into the ring 2 must be inserted a reduction ring 9 (FIG. 4). It is to be pointed out that the arm 7*e* may be vertically flattened so to transform it in a vertical fin which can act as an aerodynamic brake which imparts a tension to the yarn which is treated.

I claim:

1. An apparatus for guiding yarn towards a spool for use in connection with textile and twisting machines having at least one spindle substantially concentrically disposed within a fixed ring, a co-axial ring rotatably carried by the fixed ring, and an eyelet carried by the co-axial ring, the eyelet including a hook portion at one end of the eyelet and an arm spaced from the hook portion and defining an other end of the eyelet, the improvement to the co-axial ring and the eyelet comprising a radially oriented slot formed in the co-axial ring through which the arm of the eyelet extends in a generally radial direction, the arm having a substantially constant cross-section, the hook being generally radially inward of the co-axial ring, the slot having a vertical extent parallel to the axis of the co-axial ring only slightly larger than the cross-section of the arm and a horizontal extent along the arc of the co-axial ring which sufficiently exceeds the cross-section of the arm so as to permit a reorientation of the arm and therewith of the eyelet relative to the slot and the co-axial ring while the eyelet remains at all times in planes substantially parallel to the axis of rotation of the co-axial ring, whereby the eyelet can orient itself into positions substantially tangent to varying diameters relative to the winding diameter of the yarn on the spool to minimize friction between the eyelet and the yarn being wound onto the spool.

2. Apparatus according to claim 1 including a plurality of interchangeable eyelets, each eyelet of such plurality having a differing weight selected as a function of the denier of the yarn being wound, wherein during operation only one eyelet is carried by the co-axial ring at any one time.

3. Apparatus according to claim 1 including a reduction ring interposed between the rotating and the fixed ring.

4. Apparatus according to claim 1, wherein the eyelet includes means defining a radially outwardly opening passage between the hook portion and the arm, the passage being located intermediate the ends of the eyelet and permitting the insertion of the yarn through the passage into the hook portion.

5. Apparatus according to claim 4 wherein the arm projects radially outwardly from the hook portion and the means defining the passage.

6. Apparatus according to claim 4 wherein the arm is disposed immediately adjacent the passage, wherein the eyelet defines a curved transition between the arm and a remainder of the eyelet, and wherein the curved transition defines a portion of the passage.

7. Apparatus for guiding yarn towards a spool for use in connection with textile and twisting machines having at least one spindle substantially concentrically disposed within a fixed ring, and a co-axial ring defining a tubular wall rotatably carried by the fixed ring, the apparatus comprising an eyelet having a hook portion at one end of the eyelet disposed generally radially inward of the co-axial ring, a radially outwardly projecting arm spaced from the hook portion and defining another end of the eyelet, the arm having a substantially constant cross-section, and means defining a radially outwardly opening passage between the hook portion and the arm, the passage being located intermediate the ends of the eyelet and permitting the insertion of the yarn through the passage into the hook portion; and a radially oriented slot extending through the wall of the co-axial ring, the arm of the eyelet extending through the slot, the slot having a sufficient size in the direction of rotation of the co-axial ring so as to permit a reorientation of the arm and therewith of the eyelet relative to the slot and the co-axial ring while the eyelet remains at all times in planes substantially parallel to the axis of rotation of the co-axial ring; whereby the eyelet orients itself into positions substantially tangent to the winding diameter of the yarn on the spool to thereby minimize friction between the eyelet and the yarn being wound onto the spool.

* * * * *